United States Patent [19]

Kinney, Jr. et al.

[11] Patent Number: 4,801,410

[45] Date of Patent: Jan. 31, 1989

[54] PLASTIC FILL SHEET FOR WATER COOLING TOWER WITH AIR GUIDING SPACERS

[75] Inventors: Ohler L. Kinney, Jr., Leawood; James R. Houx, Jr., Shawnee Mission, both of Kans.

[73] Assignee: The Marley Cooling Tower Company, Mission, Kans.

[21] Appl. No.: 69,377

[22] Filed: Jul. 2, 1987

[51] Int. Cl.[4] ..... B01F 3/04

[52] U.S. Cl. ..... 261/112.2

[58] Field of Search ..... 261/112.2

[56] References Cited

U.S. PATENT DOCUMENTS

| | | | |
|---|---|---|---|
| 3,733,063 | 5/1973 | Loetel et al. | 261/112 |
| 4,320,073 | 3/1982 | Bugler, III et al. | 261/112.2 |
| 4,337,216 | 6/1982 | Korsell | 261/112.2 |
| 4,405,533 | 9/1983 | Norback et al. | 261/112.2 |
| 4,499,031 | 2/1985 | Sexton et al. | 261/112.2 |
| 4,548,766 | 10/1985 | Kinney, Jr. et al. | 261/112 |

FOREIGN PATENT DOCUMENTS

| | | | |
|---|---|---|---|
| 160176 | 3/1979 | Netherlands | 261/112.2 |
| 1226259 | 3/1971 | United Kingdom | 261/112.2 |
| 1320505 | 6/1973 | United Kingdom | 261/112.2 |

*Primary Examiner*—Tim Miles

*Attorney, Agent, or Firm*—Hovey, Williams, Timmons & Collins

[57] ABSTRACT

A vacuum-formed fill sheet for water cooling towers is provided with structure for contact with adjacent sheets for maintaining proper spacing around a perimeter of the sheets as well as between interior cooling zones formed within the sheet. Top marginal edge portions of the sheets are formed in a corrugated pattern, with the peaks and valleys of adjacent sheets being inclined in opposite directions in order to maintain sheet spacing while enabling the film flow of water thereover to cooling zones below. Honeycomb structure formed along facing, side edge portions of adjacent sheets also assists in maintenance of the requisite sheet spacing while functioning to smoothly guide the air between adjacent fill packs in a horizontal direction with a minimum of pressure loss. The honeycomb structure as well as the corrugated sections eliminate stresses within the sheets that might otherwise cause warpage sagging or bending of the latter.

12 Claims, 2 Drawing Sheets

10
20
28
40
38
22
36
72
70
44
42
34
18
16
30
32
24
14
12

PLASTIC FILL SHEET FOR WATER COOLING TOWER WITH AIR GUIDING SPACERS

BACKGROUND OF THE INVENTION

1. Field of the Invention

This invention relates to water cooling towers and especially an improved film fill assembly for use in an evaporative type cooling tower.

In particular, the invention is concerned with a film fill assembly made of packs of fill sheets arranged in vertically oriented, side-by-side relationship. The individual sheets are each formed to present not only a chevron-patterned central air-water contact zone, but also to define corrugated upper marginal sections which mutually cooperate with the same sections of adjacent sheets to provide for even distribution of hot water over the plan area of the fill assembly. Each of the sheets is further provided with partial honeycomb side marginal portions which are mutually cooperable in an assembled fill pack to define passages which control the path of inflowing or outflowing cooling air or the flow of air between horizontally aligned packs. An integral horizontally extending corrugated section may be provided if desired between the upper and lower edges of each sheet to effect redistribution of the hot water as it flows downwardly over the main air-water contact zone of respective fill sheets.

The unique shape of the film fill sheets not only permits fabrication of the individual sheets using conventional vacuum forming techniques, but also allows minimization of the number of different types of sheets which must be formed and thereafter assembled to present a pack which retains required thermal performance characteristics without untoward air pressure drop.

2. Description of the Prior Art

Water cooling tower fill assemblies for many years typically were made up of a series of horizontally oriented, flat splash bars located in horizontal and vertically spaced relationship in disposition such that hot water gravitating through the fill impacted on the bars and was broken up into droplets to increase the surface area of the water and thereby increase cooling efficiency.

In recent years, film fill packs made up of vertically positioned, horizontally spaced synthetic resin sheets have replaced the splash bars because of the flame retardant nature of such materials, the decreased size of the overall fill assembly thus lowering pumping heights, and minimization of the overall size of towers incorporating film fill units.

Film fill design parameters include the requirements of spreading the water out over the surface of the fill sheets in a thin film for maximum surface area, retarding of the gravitational flow of the water to the extent feasible to assure maximum exposure of the water to cooling air, and providing turbulent airflow without excessive air pressure drop.

To these ends, each face of sheet fill members forming multiple-sheet fill assemblies are often formed with sets of zig-zag chevron patterns which effectively increase the available surface area of the fill and decrease the velocity of flow of the descending films of water. The chevron pattern also lends itself to being produced by conventional vacuum-forming techniques, long employed in the plastics industry. During the vacuum-forming process, selected areas of the initially flat, synthetic resinous sheet are subjected to negative pressures to draw the areas into cavities of a forming die, thereby creating the desired pattern of peaks and valleys on one face of the sheet which each define a respective valley and peak on the opposite face of the sheet. In this regard, exemplary chevron pattern film fill sheets are depicted and described in U.S. Pat. Nos. 3,733,063, 4,320,073 and 4,548,766, all of which are assigned to the assignee of the present application.

Moreover, it is highly important to maintain the required spatial relationship between the chevron-patterned cooling zones of adjacent sheets of the fill assembly in order to avoid development of undue localized air pressure drops which can significantly decrease the thermal performance of the film fill. During operation of a cooling tower, it has been found that when thin synthetic resin sheets assembled into a fill are loaded with hot water, the sheets sometimes have a tendency to warp, bend or buckle thus reducing the cross-sectional area of the adjacent space available for passage of air. Additionally, because the relatively thin sheets are normally fashioned of a thermoplastic such as polyvinyl chloride, the sheets have an increased tendency to sag and warp under the normal operating conditions of the cooling tower.

At the top of the fill pack, marginal top edge portions of sheets also tend to deflect toward each other on a random basis thus precluding equal distribution of hot water across the full plan area of the film fill assembly and hindering uniform gravitational flow of water downwardly across opposed faces of each sheet of the fill pack.

In the past, integral, individual spacers have often been formed in the film fill sheets in an effort to maintain uniform spacing of the sheets throughout the pack. One example of such spacers is shown in the aformentioned U.S. Pat. No. 4,320,073 wherein outwardly extending indexing units are disposed at spaced locations throughout the chevron-shaped cooling zones of the sheet member for engagement with respective recess-defining walls located on the next adjacent sheet. While such indexing units have been found to be satisfactory when present in sufficient numbers for maintaining the desired spacing between adjacent sheets in areas within the chevron-patterned cooling zones, the spaced, integral indexing units of the cooling zones cannot be relied upon to entirely prevent warpage of top marginal edge portions of each sheet. Furthermore, if an adequate number of the spacers is provided to insure against deflection of the fill sheets, the spacers represent an impedence to airflow which alters the thermal performance of the fill pack.

For the most part, film fill assemblies have been used in small package-type water cooling towers. Recently, however, more and more emphasis has been placed on adapting such film fill assemblies for use in larger, industrial-type water cooling towers. However, the characteristics and construction of conventional vacuum forming machines limit for practical purposes the width of each sheet which may be formed on such equipment. Typically, this is a dimension of no more than about four feet. As a result, two packs of fill members are often arranged in side-by-side relationship in the direction of airflow to present a fill assembly which is of adequate dimensions between the air inlet and the air outlet. The outwardmost edge portions of the outboard fill pack sheets are normally formed to present an upright series of air inlet louvers, while the marginal, innermost edge portions of the inboard fill pack may be formed to present drift eliminator structure for separating entrained water droplets from the currents of air flowing out of the fill assembly.

Although these inclined air inlet louvers and drift eliminator components presenting air inlet and air outlet passages are of convoluted shape which prevents for the most part substantial deflection and warpage of the upright outermost edge portions of the fill sheets under normal hot water temperature conditions, the same has not been the case as to the upright edges of the fill packs which are in directly abutting, proximal relationship. However, there is also a significant need to preclude warpage and deflection of the edge portions of the fill packs which are in abutting relationship since uniform transfer of air from the outboard fill pack into the inboard fill pack is essential for maximum thermal performance efficiency.

Finally, it has often been necessary to provide a deck assembly or other water distribution structure in direct overlying relationship to the upper faces of the film fill packs underneath the hot water distribution deck or distributor apparatus in order to assure uniform loading of water across the entire plan area of the fill. Even with the attendant extra expense incurred by the provision of distribution structure overlying the film fill packs, the incorporation of such added equipment often has not resolved the problem because of warpage and deflection of the upper edges of the film fill sheets thus preventing the water from flowing in substantially equal proportional amounts into all of the spaces between proximal fill sheets rather than channeling into certain of the passages depending upon the actual extent of the open areas presented at the top of the film fill packs.

SUMMARY OF THE INVENTION

In view of the factors set forth above, it is a primary object of the present invention to provide structure for reliably maintaining openings of equal size between the edges of the sheets of a multiple-sheet film fill assembly, particularly in the regions thereof which directly receive hot water delivered onto the film fill packs, and in adjacent, abutting areas of packs which are located in tandem relationship in the direction of airflow through the cooling tower. The present invention provides spacing and water dispersing structure which extends along the top marginal edge portions of each sheet as well as horizontally along intermediate regions thereof. Spacing and air direction structure is incorporated in the fill sheets which extends in an upright direction along the facing, side edge portions of the sheets of adjacent packs.

More specifically, the spacing and water dispersing structure includes a corrugated water distribution and spacing section integrally formed along the top edge of each sheet as well as across the entire width of intermediate regions of each sheet. The corrugated pattern presents a spaced series of peaks and valleys having respective longitudinal axes which are inclined in a direction generally opposite to the longitudinal axes of the facing peaks and valleys of the next adjacent sheets. Preferably, the peaks of the corrugations are of a length to contact the peaks of the adjacent sheets at two spaced locations or crossings so that sufficient stability is provided for each sheet to avoid excessive warpage of individual sheets over the expected lifetime of the fill assembly.

At the top of each fill pack, the corrugated spacing and water dispersing structure functions to receive water directed onto the top of the fill pack from overlying nozzles or orifices and divide the same into flows which assure relatively uniform loading of the associated regions of the underlying, chevron-patterned cooling zones. The corrugated configuration of the spacing structure is such as to block the fall of water from the overlying hot water distribution basin and assure conversion of the separate streams or droplets of water into water films which flow downwardly across opposed faces of the fill sheets. In this manner, tower efficiency is significantly improved by preventing water from channeling in certain of the spaces between adjacent sheets.

In the case where intermediate regions of the film fill sheets are also provided with horizontally extending corrugated spacer and water dispersing sections, such corrugated sections serve to relieve stresses which may otherwise develop in the interior part thereof thus precluding warpage and deflection of such portions of the sheets, as well as maintaining the desired interior sheet spacings between the cooling zones of adjacent sheets. The corrugated configuration of the intermediate spacing and water dispersing structure operates to redistribute the descending films of water and assures uniform loading of the lower part of each fill pack.

In a preferred embodiment of the invention, the longitudinal axis of the peaks of every other corrugated section of each sheet are inclined at an angle of about 30° from horizontal, while the longitudinal axis of the peaks of the remaining sheets are inclined in an opposite direction at an angle of about 30° from horizontal. The projected vertical extent of each corrugation is selected so that each peak contacts two peaks of the next adjacent sheet at two spaced locations or crossing points, so that the corrugations impart adequately stability to the pack without unduly reducing the overall extent of the chevron-patterned main cooling zones of respective fill sheets. The angle of inclination of the spacing and water dispersing corrugations is preferably not greater than about 30° to avoid an unsatisfactory pressure drop of air flowing through the fill packs.

The spacing and air orientation structure which extends vertically along the directly opposed, proximal side portions of the tandem located, adjacent fill packs is of a honeycomb configuration in vertical section with upright wall segments of each sheet being in contact with wall segments of the adjacent sheets. The sheets are formed to present smooth transitions between the chevron-patterned cooling zones and the honeycomb structure, so that air exiting the outboard fill pack is guided in a horizontal direction for entry into the honeycomb structure of the air inlet face of the adjacent pack. This honeycomb structure and the transition surfaces reduce turbulence of air flowing between the packs and minimizes the effect of any misalignment of the sheets of each pack as may occur, for example, when a sheet of the outboard fill pack does not lie in a common plane with the directly adjacent sheet of the inboard fill pack.

The cooperative effect of the horizontally extending, corrugated spacing and water dispersing structure as well as the honeycomb air orientation structure extending along the adjacent edges of the sherts of both fill packs is to maintain proper sheet spacing around the perimeter of the sheets as well as the boundary of each cooling zone with a minimum of resistance to airflow through the tower. These and other objects of the invention will become apparent in the course of the following description of a preferred embodiment of our invention.

DETAILED DESCRIPTION OF THE DRAWINGS

Figure 1:
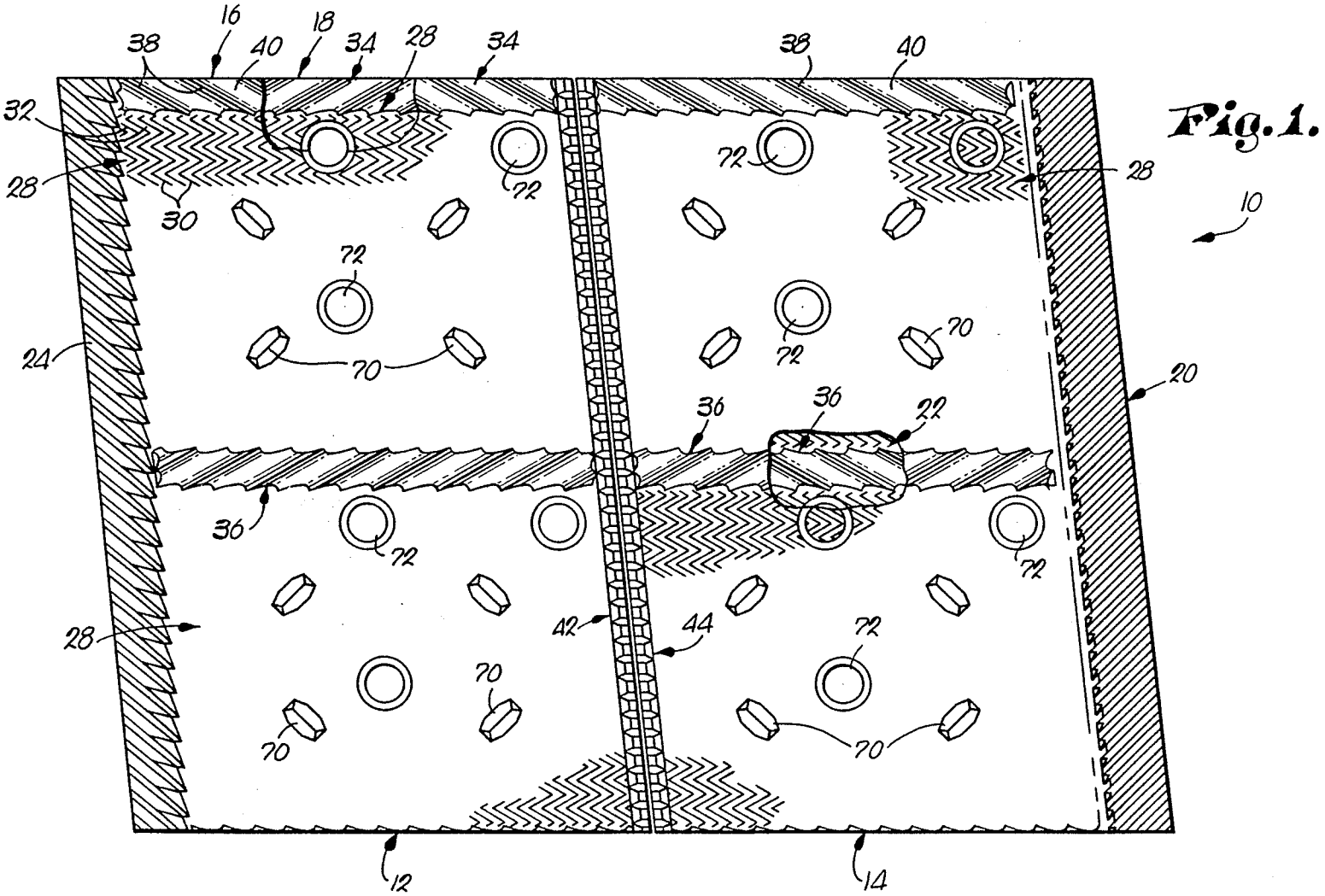
FIG. 1 is a side elevational view of a fill assembly constructed in accordance with the principles of the present invention, wherein the assembly is comprised of two side-by-side, multiple-sheet fill packs and wherein a portion of one sheet of each pack has been cut away to reveal the next adjacent sheet.

Referring initially to FIG. 1, a film fill assembly for water cooling towers is broadly designated by the numeral 10 and includes an outboard film fill pack 12 as well as an adjacent, inboard film fill pack 14. Although not shown, it is to be understood that the fill packs 12, 14 are used in a crossflow mechanical draft cooling tower having a hot water distribution means in the form of a series of nozzles, apertures or other means for delivering hot water to be cooled across the plan area of the fill assembly 10. A cold water collection basin is conventionally provided in underlying relationship to the film packs 12, 14.

Conventionally, a fan of the cooling tower draws currents of air through the film packs 12, 14 in generally transverse relationship to the flow of water descending by gravity therethrough.

The film packs 12, 14 are each in the form of a series of spaced, opposed, upright, face-to-face alternate sheet fill members 16 and 18, and 20 and 22, respectively. Each of the sheets 16–22 is advantageously of integral construction and preferably shaped by a vacuum forming process from a suitable synthetic resinous material such as polyvinyl chloride.

The outermost edges of the alternate sheets 16, 18 of the outboard fill pack 12 are formed to present a series of air inlet louvers 24 which extends along the entire height of the assembly 10. In addition, the outwardmost edge portions of the alternate sheets 20, 22 of the inboard film fill pack 14 have a series of molded drift eliminators 26 extending from the top to the bottom of assembly 10. The louvers 24 and the eliminators 26 have respective longitudinal axes which are inclined from horizontal for reasons as will be apparent to those skilled in the art.

Cooling zones 28 extend across the major extent of both faces of each of the sheets 16–22. As depicted in FIG. 1, each of the sheets 16–20 have been provided for illustrative purposes with two cooling zones 28 respectively, although a greater number of cooling zones 28 may be desirable where, for example, the length of the parallelogram-shaped sheets 16–22 of the fill packs 12, 14 is extended to match the space available in larger towers.

Referring now to FIGS. 1–3 and 5, the cooling zones 28, in more detail, are comprised of a vacuum-formed undulating, repeating pattern represented by a series of zig-zag, serpentine, chevron defining spaced ridges 30 on opposed faces of sheets 16–22 which define respective complementally configured zig-zag grooves 32 between each adjacent pair of ridges 30. The ridges 30 and grooves 32 of cooling zones 28 may be identical in construction to the zig-zag ridges and grooves of the cooling zones depicted in the aforementioned U.S. Pat. No. 4,548,766, the disclosure of which is hereby expressly incorporated into the disclosure of the present application.

Figure 2:
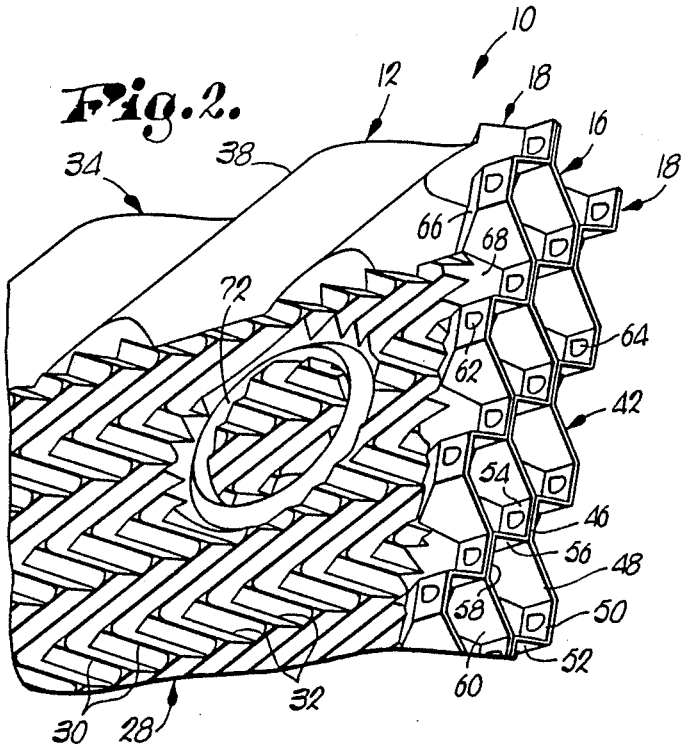
FIG. 2 is an enlarged, fragmentary, perspective view of a corner portion of three sheets of the outboard fill pack depicted in FIG. 1, illustrating vertically extending spacer structure of a honeycomb configuration, as well as horizontally extending spacer structure of a corrugated configuration.
Figure 4:
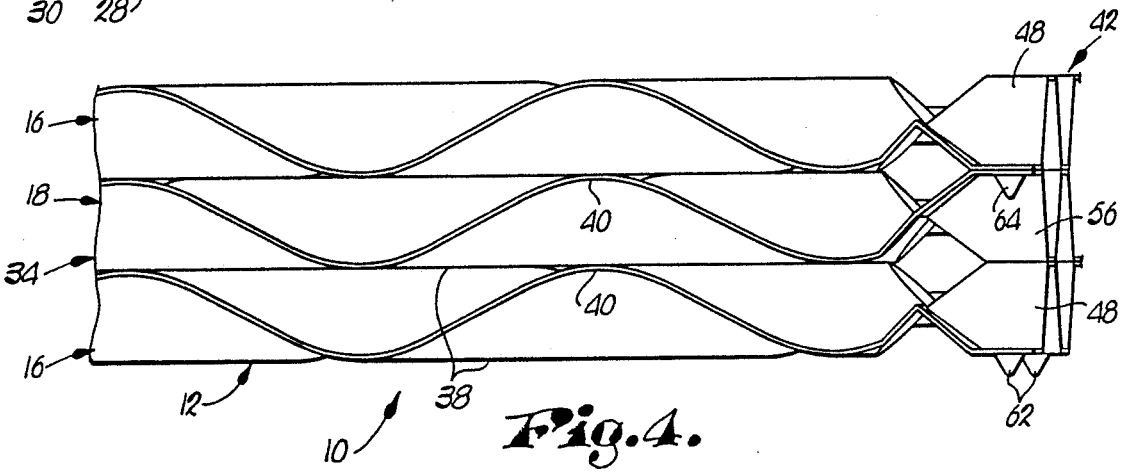
FIG. 4 is an enlarged, fragmentary, plan view of the corner portion of the fill pack that is depicted in FIG. 3.
Figure 5:
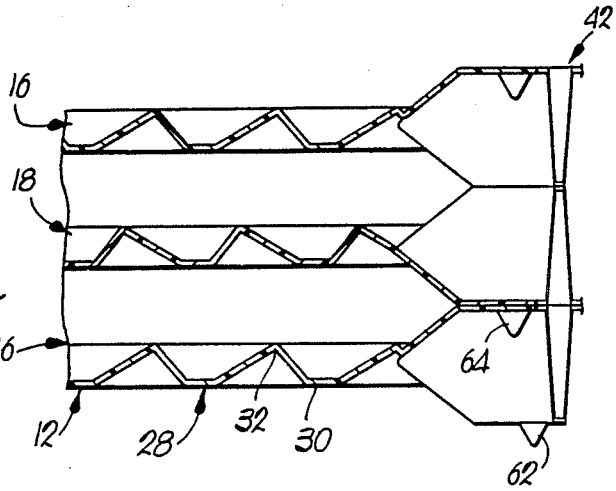
FIG. 5 is an enlarged, fragmentary, horizontal sectional view taken through the honeycomb structure and chevrons of the cooling zone of a portion of the outboard fill pack shown in FIG. 1.

Referring now to FIGS. 1, 2 and 4, each of the sheets 16–22 is shaped to present a top sheet spacing and water dispersing section 34 and an intermediate sheet spacing and air orientation section 36, and optionally sheet spacing sections may be provided where, for example, the vertical length of the respective fill sheet is greater than that which is depicted in the drawings. Both of the sheet spacing sections 34, 36 extend substantially across the entire width of the respective fill sheet 16–22.

The sheet spacing sections 34, 36 are formed in a corrugated pattern integral with the respective fill sheets 16–22 and present a spaced series of elongated peaks 38 on each face of the fill sheets 16–22. The peaks 38 are interconnected by a spaced series of corresponding valleys 40, and the peaks on one face of each fill sheet 16–22 define the valleys 40 on the opposite face thereof and vice-versa.

The peaks 38 on each face of the sheets 16–22 extend outwardly in a horizontal direction past the tops of the ridges 30 of the adjacent cooling zones 28. As an example, the thickness of the cooling zone 28 (i.e., the horizontal distance from the top of each ridge 30 on one face of the sheet to the top of the adjacent ridge 30 on the opposite face of the same sheet) may be in the order of about 0.180 inch to 0.30 inch, while the thickness of the spacing section (i.e., the horizontal distance from the top of one peak 38 to the top of the opposed, adjacent peak 38 on the opposite face of the same sheet) may be in the order of approximately 0.75 inch, although other dimensions are also possible.

The longitudinal axes of each of the peaks 38 and the valleys 40 on each face of any one sheet 16–22 are oppositely inclined relative to the longitudinal axes of the peaks 38 and the valleys 40 of the adjacent face of the next adjacent sheet 16–22, as can best be appreciated by reference to the cutaway sections of the sheets 16, 20 which are illustrated in FIG. 1. The longitudinal axes of each peak 389 and valley 40 are inclined from horizontal at an angle preferably within the range of about 20° to about 30°, and in particularly preferred embodiments of the invention, the inclination of the longitudinal axes of peaks 38 and valleys 40 is approximately 30° from horizontal.

Viewing FIG. 4, the peaks 38 of each face of each sheet 16–22 are in contact with peaks 38 of the proximal face of the next adjacent, respective sheet 16–22 in order to retain the fill sheets at regular, horizontal intervals apart and to thereby maintain a desired pre-selected horizontal spacing between the corresponding cooling zones 28 of the adjacent sheets 16–22. Importantly, the smoothly curved configuration of the peaks 38 and the oppositely inclined orientation of the peaks 38 of adjacent fill sheets 16–22 enables the corrugated spacing sections 34, 36 to engage the adjacent sections 34, 36 without the need for indexing of the sheets 16–22 in directions parallel to the planes of extension of the latter.

Preferably, the corrugated sections 34, 36 are of such a height that the peaks 38 contact the peaks 38 of the adjacent sheets 16–22 at two locations or crossing points in order to provide a desired amount of stability to the sheets 16–22 and thereby to the fill packs 12, 14. By the same token, the projected vertical extent of the corrugated sections 34, 36 is advantageously not greater than is sufficient for providing two crossing points of contact between adjacent, facing peaks 38, so that the area of the fill sheets 16–22 available for cooling zones 28 is not unduly diminished. The spacing of the sheets 16–22 is determined by the configuration of the peaks 38 and associated valleys 40, and it has been found that the preferred, 30° inclination of the peaks 38 provides two points of contact sufficient for the required stability of the sheets 16–22 within a limited projected vertical extent.

Furthermore, the corrugated sections 34, 36 function to evenly distribute water uniformly across the top of the respective cooling zones 28 disposed therebelow. Along the top marginal edge portions of each sheet 16–22, the upper sheet spacing section 34 receives streams or droplets of water dispersed from nozzle apparatus, apertures or other types of distribution structure, and the water disperses and forms a film on the surface of each face of the corrugated section 34 for gravitational flow downwardly thereacross with additional dispersion at each point of contact of adjacent peaks 38. Upon reaching the lower extremities of the upper corrugated section 34, the film continues to descend toward associated regions of the cooling zone 28, and as shown for example in FIG. 2 the face of the fill sheets 16–22 is smoothly blended in areas between the corrugated sections 34, 36 and the cooling zone 28 therebelow in order to avoid unnecessary channeling of the film of water.

Referring to FIG. 4, it can be appreciated that the configuration of the peaks 38 is such as to block the fall of substantially all of the water that is dispersed from the overlying spray apparatus. The water impacts the upper corrugated section 32 and is converted into films of water on the faces of the sheets 16–22 to avoid free-fall passage of the water through the space between the cooling zones 28 until reaching the collection basin of the tower therebelow, since otherwise such free-fall, bypassing action of the water would adversely affect the thermal performance of the fill assembly.

The upper corrugated spacing and water dispersing section 34 also advantageously maintain the top edge of respective sheets 16–22 in substantially a straight, vertical reference plane so that warpage of the top, free edge of each of the fill sheets is avoided. Moreover, it has been found that the corrugated section 34 relieves a substantial amount of sheet stress that would otherwise be present in the interior thereof.

In similar fashion, the intermediate corrugated section 36 relieves a substantial amount of stress which would otherwise be present in the associated fill sheet 16–22. In addition, the intermediate corrugated section 36, besides functioning to maintain the spacing between adjacent fill sheets is operable to receive the film of water descending from associated regions of the cooling zone 28 thereabove and evenly distribute the same along the length of the top edge of the adjacent, underlying cooling zone 28.

Referring again to FIG. 1, an innermost, side or marginal edge portion of adjacent fill sheets 16, 18 of the outboard fill pack 12 is integrally formed at a location remote from the air inlet louvers 24 to present a honeycomb structure 42 which is shown in more detail in FIGS. 2–5. Similarly, inner sides or marginal edge portions of sheets 20, 22 of the outboard fill pack 12 are constructed to present a honeycomb structure 44 complemental to and facing the honeycomb structure 42. Both of the honeycomb structures 42, 44 extend along the entire vertical extent of the respective fill packs 12, 14.

Figure 3:
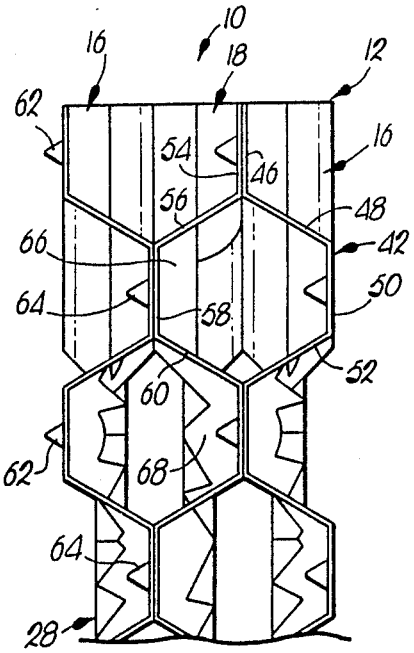
FIG. 3 is an enlarged, fragmentary end view of an inner, top corner portion of three sheets of the outboard fill assembly depicted in FIG. 1 taken in a direction toward outer regions of the fill pack through the honeycomb structure.

More specifically, and referring to FIGS. 2 and 3, the marginal side edge portion of fill sheet 16 comprises a first upright wall segment 46, a first inclined wall segment 48 that depends from wall segment 46, a second upright wall segment 50 laterally offset from segment 46, and a second inclined wall segment 52 that depends from segment 50 in a direction opposite to the direction of inclination of wall segment 48. In opposite fashion, the marginal side edge portion of fill sheet 18 is formed to present upright, offset wall segments 54, 58 that are connected to oppositely inclined wall segments 56, 60. The segments 46–52 continue in a repeating pattern along the length of the edge portion of fill sheet 16, while the segments 54–60 continue in a repeating cycle down the length of the side portion of fill sheet 18.

When the fill pack 12 is assembled such that the corrugated spacing sections 34, 36 are in contact with each other, the upright wall segments 46 of fill sheet 16 engage upright wall segments 54 of fill sheet 18. At the same time, the upright segments 58 of the fill sheet 18 contact upright wall segments 50 of the fill sheet 16. As a result, the segments 46–60 combine to present a repeating, nested, staggered pattern of hexagons in vertical section, thus yielding the honeycomb-type appearance.

In preferred forms of the invention, the wall segments 46, 58 of sheets 16, 18 respectively are formed to present horizontally extending indexing units 62 having a generally conical configuration. The units 62 are received within corresponding, complementally configured recess defining walls 64 that are integrally formed as part of upright wall segments 50, 54. The units 62 interlock with the recess defining wall 64 when the packs 12, 14 are assembled in order to increase the rigidity of the packs 12, 14 while retaining adjacent regions of the sheets 16–22 in a desired position and orientation.

The wall segments 46–60 are blended into adjacent regions of the cooling zones 28 (or, alternatively, the corrugated spacing sections 34 or 36) by inclined wall portions such as portions 66, 68 which can best be appeciated by reference to FIG. 2. Thus, the adjacent ends of the ridges 30 and grooves 32 of the adjacent cooling zone 28 directly connect with respective areas of the inclined wall portions 66, 68.

The honeycomb structure 42, 44 and particularly the wall segments 46–60 thereof function to guide the currents of air which are flowing in a generally horizontal direction through the fill assembly 10. More particularly, the honeycomb structure 42, 44 guides along a horizontal path and with minimal pressure loss air that is exiting from the outboard fill pack 12 and is entering the inboard fill pack 14. In this regard, fill packs 12, 14 are often spaced a slight distance apart (such as 0.25 inch) for ease of assembly and so that stresses developed in one of the fill packs 12, 14 are not transmitted to the other pack.

In addition to horizontally guiding the air from fill pack 12 to fill pack 14, the honeycomb structures 42, 44 assure that the flow rate of air discharged from the fill pack 12 and entering fill pack 14 is substantially uniform across the entire vertical extent of the asembly 10, so that a uniform supply of air is provided to all areas of the cooling zones 28. Also, the upright wall segments 46, 50, 54 and 58 provide a means for retaining adjacent fill sheets 16–22 a predetermined horizontal distance apart from each other, so that the space between adjacent areas of the cooling zones 28 is reliably maintained at a certain, preselected dimension.

In this regard, the horizontal distance between offset, upright wall segments 46, 50 and 54, 58 is substantially equal to the horizontal distance between peaks 38 and valleys 40 of corrugated sections 34, 36 so that the honeycomb structures 42, 44 cooperate with the corrugated sections 34, 36 to maintain the spacing between adjacent areas of the cooling zones 28.

Finally, and again referring to FIG. 1, the sheets 16–22 are formed with integral spacers 70 interspersed throughout the cooling zones 28. Also, circular knockouts 72 which interrupt the serpentine pattern of ridges 30 and grooves 32 may be removed to receive tubular supports secured to opposite side walls of the water cooling casing for mounting the fill packs 12, 14 within the tower. Both the circular knockouts 72 and the spacers 70 may be of the type described in more detail in the aforementioned U.S. Pat. No. 4,548,766.

The cooperative effect of the honeycomb structures 42, 44, the corrugated sections 34, 36 as well as spacers 70, louvers 24 and eliminators 26 is to maintain proper spacing around the entire perimeter of the fill sheets 16, 22 within practical dimensions of the latter. In this manner, stresses within the sheets 16, 22 are reduced and the likelihood of warpage of the fill sheets 16–22 is largely avoided. As a consequence, air which is drawn into the assembly 10 encounters a uniform pressure drop throughout all regions of the fill packs 12, 14 so that uniform cooling of the descending water is assured and channeling of both the air and water is substantially eliminated.

We claim:

1. A film fill pack for water cooling towers comprising:

a series of upright, generally parallel sheets of material each presenting two faces, said sheets being disposed in a row of generally face-to-face relationship to each other, each face of each of said sheets presenting at least one cooling zone adapted to receive thereover a descending film flow of water to be cooled, said at least one cooling zone of each face of said sheets being horizontally adjacent one of said at least one cooling zone of the next adjacent sheet and spaced therefrom for enabling the flow of air through said pack in generally transverse relation to said descending flow of water to be cooled, said sheets each having at least one sheet spacing section extending in a generally horizontal direction and formed in a corrugated pattern presenting a spaced series of elongated peaks on each face of said sheets, said peaks being interconnected by a spaced series of corresponding valleys, the peaks on one face of each sheet defining the valleys on the opposite face thereof and vice-versa, said peaks on each face of the sheet extending outwardly in a horizontal direction past said at least one cooling zone of the respective face of each corresponding sheet, the longitudinal axes of said peaks of each face being inclined relative to the longitudinal axes of the peaks of the adjacent face of the next adjacent sheet, said peaks of each face being in contact with the peaks of the adjacent face of the next adjacent sheet in order to maintain a desired, preselected horizontal spacing between the cooling zones of adjacent sheets, certain of the cooling zones being bounded above and below by corresponding sheet spacing sections extending substantially across the entire width of the respective sheet at an intermediate portion of said sheet for precluding excessive warpage of the respective sheets and to redistribute the liquid.

2. The invention as set forth in claim 1, wherein said at least one sheet spacing section extends across substantially the entire width of each respective sheet and is thereby operable to distribute water descending in a film over each face of the sheet to any cooling zone disposed therebelow.

3. The invention as set forth in claim 2, wherein certain of said sheet spacing sections extend along a top marginal edge region of the corresponding sheet for receiving hot water to be cooled from water dispersing apparatus thereabove and for distributing said water to the respective, underlying cooling zones.

4. The invention as set forth in claim 1, wherein each of said peaks are of a certain lineal extent such as to contact said peaks of the next adjacent sheet at two spaced locations.

5. The invention as set forth in claim 1, wherein the longitudinal axis of each of said peaks is inclined at an angle in the range of from approximately 20° to approximately 30° relative to horizontal.

6. The invention as set forth in claim 5, wherein the longitudinal axis of each of said peaks is inclined at an angle of approximately 30° from horizontal.

7. A film fill assembly for water cooling towers comprising:

an outboard fill pack having a series of upright, generally parallel, face-to-face sheets of material disposed along a row; and an inboard fill pack having a series of upright, generally parallel, face-to-face sheets of material disposed in a row substantially parallel to and horizontally offset from said row of sheets of said outboard fill pack, each of said sheets of said outboard fill pack and said inboard fill pack presenting upright marginal edge portions with said marginal edge portions of said inboard fill pack being directly adjacent said marginal edge portions of said outboard fill pack in side-to-side, facing relationship to the latter, said sheets of material of said outboard fill pack and said inboard fill pack each including at least one cooling zone adapted to receive thereover a descending film flow of water to be cooled, each of said cooling zones being disposed in horizontally spaced relationship from a cooling zone of the next adjacent sheet, said outboard fill pack including walls defining an air inlet for admitting air to the spaces between the cooling zones of adjacent sheets for thermal interaction with the descending film flow of water, said inboard fill pack including means defining an air outlet for the discharge of air from the spaces between said cooling zones, said marginal edge portions of said outboard fill pack and said inboard fill pack each including structure for guiding air from said cooling zones of said outboard fill pack and toward respective, adjacent cooling zones of said inboard fill pack along a generally horizontal path, said structure including means in contact with adjacent sheets for retaining adjacent sheets a predetermined horizontal distance apart from each other in order to maintain a desired spacing between the cooling zones of said outboard fill pack and said inboard fill pack, each having at least one sheet spacing section extending in a generally horizontal direction at an intermediate portion of said sheet to redistribute the liquid and formed in a corrugated pattern presenting a spaced series of elongated peaks on each face of said sheets, said peaks being interconnected by a spaced series of corresponding valleys, the peaks on one face of each sheet defining the valleys on the opposite face thereof and vice-versa, said peaks on each face of the sheet extending outwardly in a horizontal direction past said at least one cooling zone of the respective face of each corresponding sheet, the longitudinal axes of said peaks of each face being inclined relative to the longitudinal axes of the peaks of the adjacent face of the next adjacent sheet, said peaks of each face being in contact with the peaks of the adjacent face of the next adjacent sheet in order to maintain a desired, preselected horizontal spacing between the cooling zones of adjacent sheets.

8. The invention as set forth in claim 7, wherein said structure extends substantially the entire vertical extent of each respective fill pack sheet.

9. The invention as set forth in claim 7, wherein said structure presents a generally honeycomb configuration in vertical section with upright wall segments of each sheet in contact with upright wall segments of adjacent sheets.

10. The invention as set forth in claim 9; including a plurality of horizontally extending indexing units associated with said structure of said marginal edge portions; and a plurality of complementally configured recess defining walls each adapted to receive a corresponding indexing unit.

11. The invention as set forth in claim 7, wherein said at least one sheet spacing section extends across substantially the entire width of each respective sheet and is thereby operable to distribute water descending in a film over each face of the sheet to any cooling zone disposed therebelow.

12. The invention as set forth in claim 11, wherein said structure presents a generally honeycomb configuration in vertical section and extends substantially the entire vertical extent of each respective fill pack sheet, said structure of each sheet including upright wall segments in contact with upright wall segments of adjacent sheets.

* * * * *